US007377513B2

(12) United States Patent
Friedman

(10) Patent No.: US 7,377,513 B2
(45) Date of Patent: May 27, 2008

(54) METHOD OF PLAYING A DICE GAME SIDE BET

(75) Inventor: Stacy Friedman, San Mateo, CA (US)

(73) Assignee: Olympian Gaming LLC, Beaverton, OR (US)

( * ) Notice: Subject to any disclaimer, the term of this patent is extended or adjusted under 35 U.S.C. 154(b) by 169 days.

(21) Appl. No.: 11/064,444

(22) Filed: Feb. 23, 2005

(65) Prior Publication Data

US 2005/0253334 A1 Nov. 17, 2005

Related U.S. Application Data

(60) Provisional application No. 60/547,904, filed on Feb. 25, 2004.

(51) Int. Cl.
*A63F 9/04* (2006.01)

(52) U.S. Cl. ..... 273/274

(58) Field of Classification Search ..... 273/274, 273/292, 309
See application file for complete search history.

(56) References Cited

U.S. PATENT DOCUMENTS 4,346,900 A * 8/1982 Lamlee ..... 273/274
5,308,081 A * 5/1994 Bartle ..... 273/274
5,413,351 A * 5/1995 Franklin ..... 273/274
5,791,651 A * 8/1998 Bryant ..... 273/274
5,806,847 A * 9/1998 White et al. ..... 273/309
5,829,748 A * 11/1998 Moore, Jr. ..... 273/274
5,964,463 A * 10/1999 Moore, Jr. ..... 273/274
6,209,874 B1 * 4/2001 Jones ..... 273/274
6,257,579 B1 * 7/2001 Horan ..... 273/274
6,974,132 B2 * 12/2005 Sorge ..... 273/274
2004/0251626 A1 * 12/2004 Porter et al. ..... 273/146
2005/0121851 A1 * 6/2005 Cacas ..... 273/146

OTHER PUBLICATIONS

Casino Operations Management, by Jim Kilby & Jim Fox, (New York: John Wiley & Sons, Inc.) pp. 197-229, 321-333, 1998.*
Managing Casinos, by Ruben Martinez, (New York: Brricade Books), pp. 40-43.*
Scarne's Encyclopedia of Games, by John Scarne (New York: Harper & Row Publishiers), pp. 455-464, 1961.*

* cited by examiner

*Primary Examiner*—William M. Pierce
(74) *Attorney, Agent, or Firm*—Muskin & Cusick LLC

(57) ABSTRACT

A craps side wager. The player can choose whether the next roll will be even or odd. If the player chose wrong, the player loses the wager. If the player chose right, then the player can win even money on the wager, unless the roll is a craps number, in which the player can win less than even money.

2 Claims, 3 Drawing Sheets

METHOD OF PLAYING A DICE GAME SIDE BET

CROSS REFERENCE TO RELATED APPLICATIONS

This application claims benefit and priority of provisional application No. 60/547,904, filed on Feb. 25, 2004, which is incorporated by reference herein in its entirety.

BACKGROUND OF THE INVENTION

1. Field of the Invention

The present invention is directed to a method, apparatus, and computer readable storage medium directed to a wager for dice games.

2. Description of the Related Art

All casino wagers involve winning some multiple of the amount wagered when the wager is won. Typically, the amount won is less than the true odds of winning the bet, and this difference yields the house edge. As an example, the odds of winning a Place-4 bet in craps are 2-to-1 against, but the wager is paid at 9-to-5 or 1.8-to-1. The 0.2 difference between 2 and 1.8 is retained by the house, yielding a house advantage of 6.67%. In American Roulette, the Red or Black wagers pay at even-money or 1-to-1 even though the chances of winning are 20-to-18 against. In the special case of the "free odds" bets in craps, the payout exactly matches the true odds of winning, and the house has no advantage. It should be noted that this wager is not available unless another wager with a house advantage (the Passline) has already been made.

Although games involving dice are extremely popular in non-gaming environments, only craps has been successful in a gaming environment. The game of craps is offered in nearly all casinos. Craps involves two six sided dice which are rolled two or more times by a designated player (the "shooter"). The fundamental bet in craps is known as the "pass" bet. The pass line bet is lost on a first roll ("come out") of 2, 3, or 12. Each pass bet wagered is paid even money on a come out roll of 7 or 11. In either case, the pass bet is resolved and a new wager must begin. Should the shooter's come out roll be a 4, 5, 6, 8, 9, or 10, that number is identified as the "point." Thereafter, the shooter continues to roll the dice until the point is repeated or a seven is rolled, whichever occurs first. If the point is repeated ("making the point"), each pass wagerer is paid even money on their pass bets and a new game begins with the same shooter. If a seven is rolled ("seven-out") prior to making the point, each pass bet wagerer loses their pass bet and the shooter must relinquish the dice to another participant. Craps also includes a host of additional wager opportunities related to each roll of the dice. For example, players may wager that any number will be rolled on a subsequent roll, bet that the value of each die will match (e.g. snake eyes), and so on.

Several other dice games have been attempted in casinos, but without great, or even moderate, success. One such game is known as "Chuck-a-Luck." Chuck-a-Luck is a game involving a single roll of three six sided dice having associated payouts related to one, two, or three of the dice faces showing a selected number from one to six. Another dice game is known as "Under and Over 7." Under and Over 7 allows players to wager whether the sum of two dice will be less than, more than or equal to seven.

While popular, a significant disadvantage of craps, for both the casino and player, is that the game is, or at least has the perception of being, complicated. Therefore, new players are reluctant to step up to a craps table and face embarrassment for not knowing the rules or etiquette of the game. In addition, craps can be played at a slow pace because of the numerous wagers being made before each roll and subsequently paid after each roll. Such delays are not conducive to generating income for the casino which generates income on a per roll basis.

A disadvantage associated with nearly every other dice game is the poor payback percentages. For example, Chuck-a-Luck has a house advantage of nearly eight (8) percent, and Under and Over 7 has a house advantage in excess of sixteen (16) percent. By contrast, the house advantage on the popular pass bet in craps is only 1.41%.

Therefore, what is needed is a novel dice-related which can be profitable for casinos and exciting and easy to understand for the players.

SUMMARY OF THE INVENTION

It is an aspect of the present invention to provide a side wager for craps that can be exciting for players.

The above aspects can be obtained by a method that includes (a) accepting a player wager; (b) selecting a random outcome using dice, cards, tokens or other indicia; (c) determining whether said random outcome meets a criteria for a winning outcome; (d) if said random outcome is a winning outcome: (e) determining whether said outcome qualifies for a true-odds payout, and if so, paying the player at the overall true odds of winning the wager; (f) if said winning outcome does not qualify for a true-odds payout, paying the player at less than the true odds of winning the wager; and (g) if said outcome is not a winning outcome, taking the player wager.

The above aspects can also be obtained by a method that includes (a) conducting a standard craps game; (b) receiving a wager from a player on either an even result or an odd result; (c) determining a random outcome using dice; (d) if the outcome is even and the wager is on an even result, then if said outcome is an even number, paying 1-to-1 if the outcome is not a craps number, and less than 1-to-1 if the outcome is a craps number, and if the outcome is an odd result then taking the wager; and (e) if the outcome is odd and the wager is on an odd result, then if said outcome is an odd number, paying 1-to-1 if the outcome is not a craps number, and less than 1-to-1 if the outcome is a craps number, and if the outcome is an even result then taking the wager.

The above aspects can also be obtained by an apparatus that includes (a) an area marked pass for making a pass wager; (b) an area marked don't pass for making a don't pass wager; (c) an area marked odd for making an odd wager; and (d) an area marked even for making an even wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
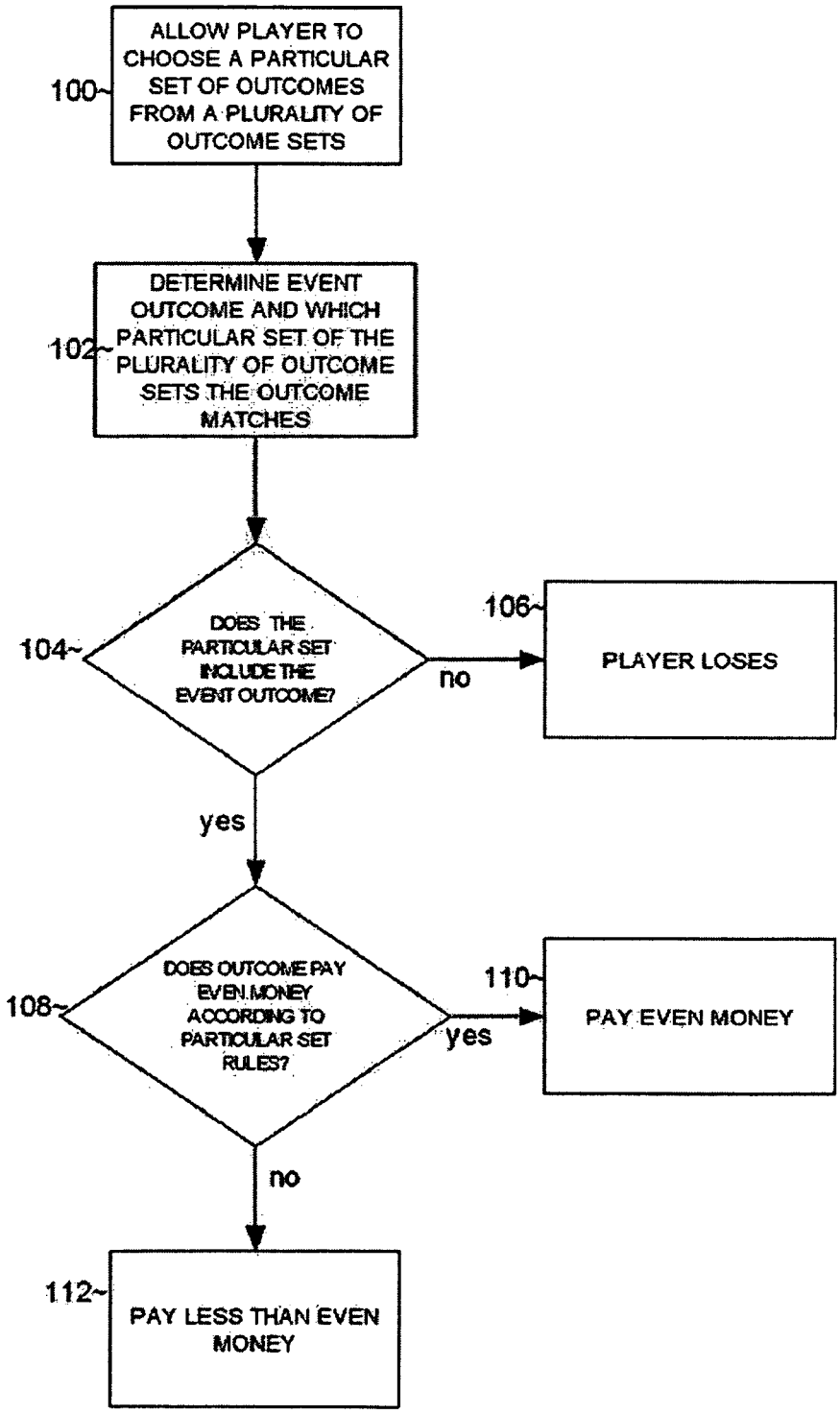
FIG. 1 is a flowchart illustrating an exemplary general method of implementing a wager, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage to implement a wager, a dice wager, and a dice wager used for craps.

With a pair of dice, the probability of rolling an even sum or an odd sum is 50% in both cases. If the casino made a wager with a player for even-money (1-to-1), neither the casino nor the player would have a theoretical edge. By paying the player less than even money on certain winning combinations, the house can regain the edge necessary for it to operate the game profitably.

The Even wager is a side bet for craps or any other sum-of-two-dice game. It will pay 1-to-1 on any even sum, except 2 or 12, in which case it will pay 0.8-to-1. The Odd wager is also a side bet for craps or any other sum-of-two-dice. It will pay 1-to-1 on any odd sum, except 3, in which case it will pay 0.8-to-1. Noting the difficulty of paying a fractional amount per unit wagered, this wager should be required to be made in multiples of 5 units. A bet of $5 on the Even or Odd wagers will win either $5 in the typical winning case, or $4 in the infrequent winning case. In the case of a loss, of course, the bettor will lose $5. By paying at true odds a majority of the time, that is, by usually paying 1-to-1 on an overall 50% chance of winning, the player will feel less shortchanged yet the house will retain an advantage.

An additional advantage of the Even or Odd bets as described herein is the 1.11% house edge. 1.11% is lower than any other wager on the craps table, even lower than the passline's 1.41% house edge. Since the house edge is the metric often used by savvy players to determine their bet selection, having the lowest edge on the table is sure to entice more wagering action. In addition, while the average time to resolve a passline wager is 3.375 rolls of the dice, the average time to resolve an Even or Odd wager is only one roll. That means the house expects to win more than 2.65× from the Even or Odd wagers as it would on the passline, making these wagers much more profitable for the casino. Finally, the numbers triggering reduced payouts are thematically significant in the game of craps: they are the "craps" numbers themselves, 2, 3, and 12.

Additional embodiments of this invention may include similar side bets on a dice game with more than two dice, or other side bets or standalone wagers (not side bets) in numerical-sum games with any number of dice, cards, or other gaming tokens. In another embodiment with three dice, the chances of rolling an even or odd sum are still 50% each. By paying 1-to-1 on most even sums but 0.8-to-1 on even sums of 6 and 16, the house realizes an advantage of 1.48%. Similarly, by paying 1-to-1 on most odd sums but 0.8-to-1 on odd sums of 5 and 15, the house realizes the same advantage of 1.48%. In a third embodiment with cards, the chances of a second card drawn being greater or less than a first card drawn are exactly 50% each, when ties are counted as non-resolutions (pushes). By paying less than 1-to-1 in certain cases, as in when the second card beats the first by only one rank, or alternatively by ten or more ranks, this simple high/low game can have a house advantage. In all embodiments, alternate reduced payouts and alternate reduced-pay outcomes may be used to modify the overall house advantage.

FIG. 1 is a flowchart illustrating an exemplary general method of implement a dice wager, according to an embodiment.

The method starts with operation 100, which allows a player to choose a particular set of outcomes from a plurality of outcome sets. This can be accomplished, for example, by placing a wager on a particular betting area for the chosen outcome set.

From operation 100, the method can proceed to operation 102, which determines an event outcome and which particular set of the plurality of outcomes sets the event outcome matches. The event outcome can be determined, for example, by rolling dice, revealing cards, using an electronic random number generator, etc.

From operation 102, the method can proceed to operation 104, which determines if the particular set chosen by the player includes event outcome determined in operation 102. If the event outcome does not fall in the particular chosen set, then the method proceeds to operation 106, wherein the player loses the wager.

If the determination in operation 104 determines that the event outcome falls in the particular chosen set, then the method can proceed to operation 108, which determines if the outcome pays even money. This can be done by referring to particular game rules, such as that indicated on a paytable. If the outcome pays even money, then the method can proceed to operation 110, which pays even money.

If the determination in operation 108 determines that the outcome does not pay even money, then the method can proceed to operation 112 which can pay less than even money. A set of rules or a paytable can be used to determine the payout. Alternatively, this payout can actually pay more than even money (of course other payouts would have to be reduced).

Figure 2:
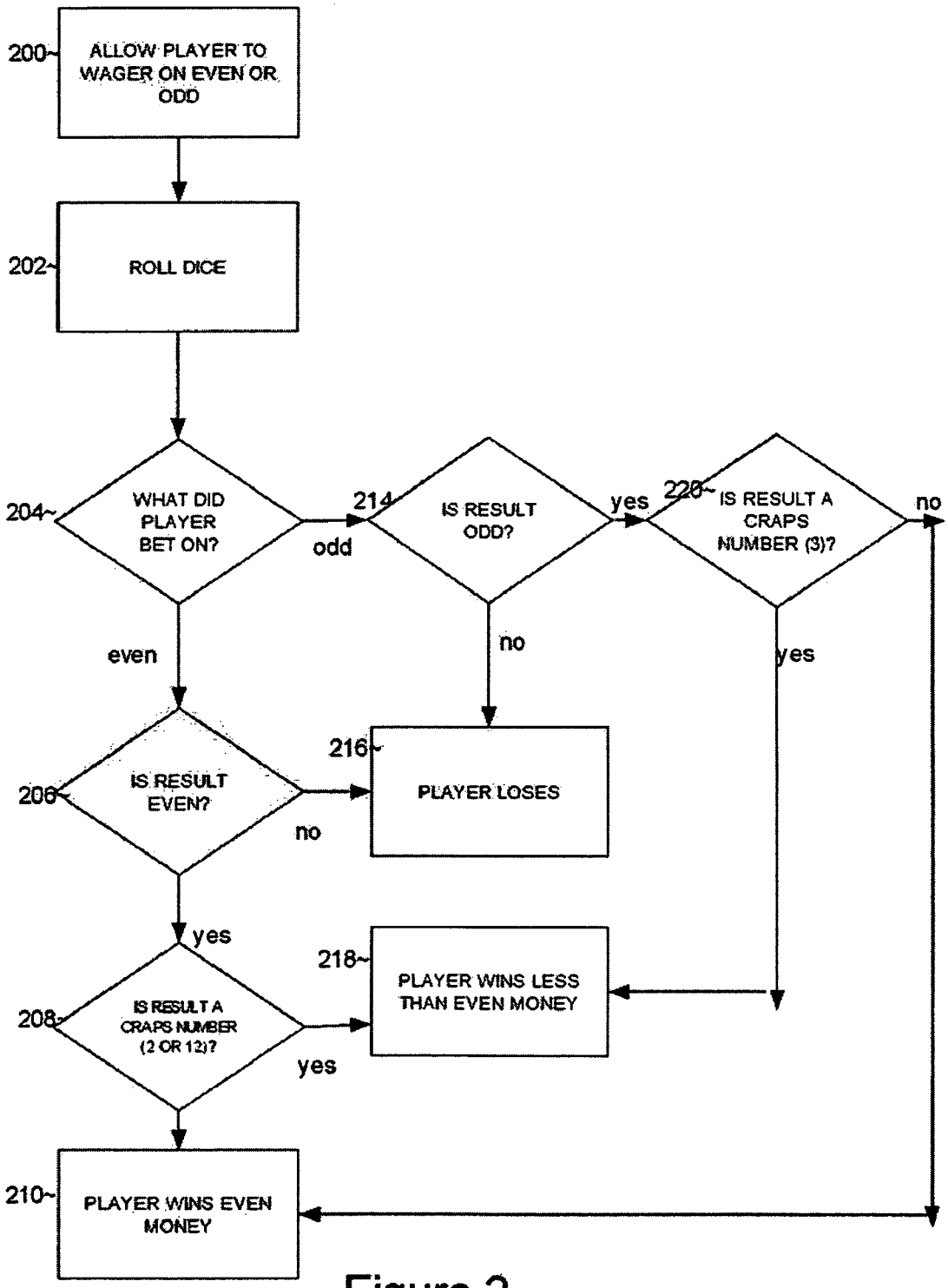
FIG. 2 is a flowchart illustrating an exemplary method of implementing a dice wager, according to an embodiment.

FIG. 2 is a drawing illustrating an exemplary table layout to implement a dice wager, according to an embodiment.

The method can start with operation 200, which allows the player to wager on even or odd. This can be done, for example, by placing a wager on a particular betting circle, using a mouse (or other input device for an electronic implementation of the wager), etc.

The method can then proceed to operation 202, which rolls the dice. This can be done as known in the art.

The method can then proceed to operation 204, which determines what the player bet on.

If the determination in operation 204 determines that the player bet on even, then the method can proceed to operation 206, which determines if the result is even.

If the determination in operation 206 determines that the result is not even, then the method can proceed to operation 216, wherein the player loses the wager.

If the determination in operation 206 determines that the result is even then the method can proceed to operation 208, which determines if the result is a craps number (2 or 12). Three is also a craps number, but it is not possible to roll a three and arrive at this operation. If the result is not a craps number, then the method proceeds to operation 210, which awards the player even money on his or her wager. The wager is typically over at this point.

If the determination in operation 208 determines that the result is a craps number, then the method can proceed to operation 218, wherein the player can win less than even money (e.g. 0.8 to 1 or another ratio). The wager is typically over at this point.

If the determination in operation 204 determines that the player bet on odd, then the method can proceed to operation 214, which determines if the result is odd. If the result is not odd, then the method can proceed to operation 216, wherein the player loses the wager. The wager is typically over at this point.

If the determination in operation 214 determines that the result is odd, then the method can proceed to operation 220, which determines whether the result is a craps number. If the result is not a craps number, then the method can proceed to operation 210, wherein the player wins even money. The wager is typically over at this point.

If the determination in operation 220 determines that the result is a craps number (3), then the method can proceed to operation 218, wherein the player wins less than even money. The wager is typically over at this point. Note that while 2 and 12 are also craps numbers, it is not possible to be at this operation with these numbers. It is also noted that the payout for an even craps number need not be identical to the payout for an odd craps number, although it is preferred.

The wager described herein can be made on any roll at any time on the craps table, or it can be limited to certain rolls. Payouts can also be changed according to the casino's preferences. The game can be used with a special table layout which allows players to indicate their wager on odd or even on betting areas marked 'odd' or 'even.'

Figure 3:
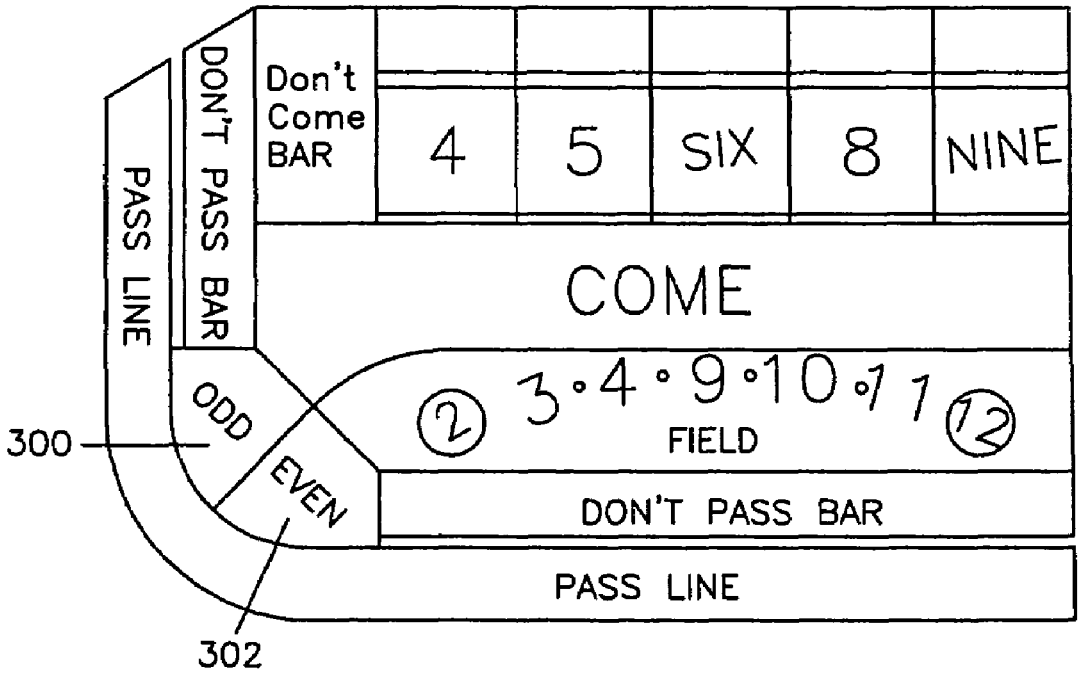
FIG. 3 is a drawing illustrating an exemplary table layout to implement a dice wager, according to an embodiment.

FIG. 3 is a drawing illustrating an exemplary table layout to implement a dice wager, according to an embodiment.

A standard craps layout felt can be used to implement the side wager described herein. The 6 and 8 bets on a standard craps layout can be removed in order to make room for the 'odd' and 'even' betting areas. An odd betting area 300 replaces the 6 betting area previously found on a standard craps layout, and an even betting area 302 replaces the 8 betting area previously found on a standard craps layout. The 6 and 8 bets are seldom used anyway.

Of course, the layout illustrated in FIG. 3 is exemplary, and other layouts can be used as well. Further, the 6 and 8 betting areas do not need be removed, but a standard craps layout can be augmented with an odd and even betting areas. Not pictured in FIG. 3 are other standard equipment needed in a craps game such as dice, etc.

This game is suitable for implementation in a live table game setting or in any electronic representation of such a game, including but not limited to a physical slot machine console and an Internet implementation.

It is also noted that any and/or all of the above embodiments, configurations, variations of the present invention described above can mixed and matched and used in any combination with one another.

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of wagering during a game of craps, the method comprising performing in any order the operations of:

a) conducting a craps game;

b) receiving a wager from a player on either an even result or an odd result wherein each result has a fifty percent chance of occurring;

c) determining a random outcome using dice;

d) if the wager is on an even result, then performing operations e and h:

e) if the outcome is an even result, then performing operations f and g:

f) if the outcome is not one of a predetermined set of number(s), then paying true odds at 1 to 1 on the wager;

g) if the outcome is one of the predetermined set of number(s), then paying less than true odds at less than one 1 to 1 on the wager;

h) if the outcome is an odd result, then taking the wager;

i) if the wager is on an odd result, then performing operations j and m:

j) if the outcome is an odd result, then performing operations k and 1:

k) if the outcome is not one of the predetermined set of number(s) then paying true odds at 1-to-1 on the wager;

l) if the outcome is one of the predetermined set of number(s), then paying less than true odds at less than 1-to-1 on the wager; and m) if the outcome is an even result, then taking the wager.

2. The method as recited in claim 1, wherein the predetermined set of numbers is 2, 3, and 12.

* * * * *